US010563471B2

(12) United States Patent
Georgsen et al.

(10) Patent No.: US 10,563,471 B2
(45) Date of Patent: Feb. 18, 2020

(54) ANCHOR MODULE, CASING PLUG ASSEMBLY AND METHOD FOR OPERATING A CASING PLUG ASSEMBLY IN A WELL PIPE

(71) Applicant: Interwell Technology AS, Ranheim (NO)

(72) Inventors: Steinar Georgsen, Trondheim (NO); Markus Morland, Bergen (NO); Stian Marius Hansen, Trondheim (NO)

(73) Assignee: Interwell Technology AS, Ranheim (NO)

( * ) Notice: Subject to any disclaimer, the term of this patent is extended or adjusted under 35 U.S.C. 154(b) by 134 days.

(21) Appl. No.: 15/572,590

(22) PCT Filed: May 27, 2016

(86) PCT No.: PCT/EP2016/061984
§ 371 (c)(1),
(2) Date: Nov. 8, 2017

(87) PCT Pub. No.: WO2016/189123
PCT Pub. Date: Dec. 1, 2016

(65) Prior Publication Data

US 2018/0283116 A1 Oct. 4, 2018

(30) Foreign Application Priority Data

May 28, 2015 (NO) ..... 20150683

(51) Int. Cl.
*E21B 23/01* (2006.01)
*E21B 23/04* (2006.01)
(Continued)

(52) U.S. Cl.
CPC ..... *E21B 23/01* (2013.01); *E21B 33/128* (2013.01); *E21B 33/1285* (2013.01); *E21B 33/1292* (2013.01)

(58) Field of Classification Search
CPC ..... E21B 23/00; E21B 23/004; E21B 23/01; E21B 23/006; E21B 23/06; E21B 33/12;
(Continued)

(56) References Cited

U.S. PATENT DOCUMENTS 1,971,514 A 8/1934 Stone
3,002,562 A 10/1961 Carothers
(Continued)

FOREIGN PATENT DOCUMENTS

GB 846859 A 8/1960
GB 2241722 A 9/1991
(Continued)

OTHER PUBLICATIONS

International Search Report issued in corresponding application No. PCT/EP2016/061984 dated Dec. 22, 2016 (5 pages).
(Continued)

*Primary Examiner* — Kenneth L Thompson
(74) *Attorney, Agent, or Firm* — Osha Liang LLP

(57) ABSTRACT

A casing plug assembly and method for performing an operation in a well pipe includes a running tool for connection to a drill pipe, an equalizing module, a seal module, and an anchor module. A continuous fluid channel is formed through the casing plug assembly. The anchor module is set in the well pipe by pumping fluid through the continuous fluid channel. The anchor module is, in the set state, providing a support in the well pipe used by the running tool to operate the seal module.

16 Claims, 7 Drawing Sheets

(51) Int. Cl.
*E21B 23/06* (2006.01)
*E21B 33/128* (2006.01)
*E21B 33/129* (2006.01)

(58) Field of Classification Search
CPC .. E21B 33/128; E21B 33/129; E21B 33/1292; E21B 33/1293; E21B 33/1294; E21B 33/1295
See application file for complete search history.

(56) References Cited

U.S. PATENT DOCUMENTS 3,294,171 A 12/1966 Kelley
3,356,142 A 12/1967 Crow et al.
3,426,846 A 2/1969 Young
3,520,361 A 7/1970 Lewis
3,714,983 A 2/1973 Wilson
4,018,274 A * 4/1977 Cochran ..... E21B 23/06 166/129
4,311,194 A * 1/1982 White ..... E21B 23/04 166/120
7,077,212 B2 * 7/2006 Roesner ..... E21B 23/06 166/120
8,418,772 B2 * 4/2013 Millet ..... F16L 55/136 166/136
8,469,089 B2 * 6/2013 Maier ..... E21B 33/128 137/493.1
8,899,337 B2 * 12/2014 Surjaatmadja ..... E21B 23/01 166/382
9,359,854 B2 * 6/2016 Hughes ..... E21B 33/12
9,650,858 B2 * 5/2017 Williamson ..... E21B 33/128
9,719,334 B2 * 8/2017 Jani ..... E21B 43/114
9,845,651 B2 * 12/2017 McCoy ..... E21B 33/134
10,024,150 B2 * 7/2018 Andreychuk ..... E21B 43/26
2006/0272825 A1 12/2006 Royer
2012/0175108 A1 7/2012 Foubister et al.

FOREIGN PATENT DOCUMENTS

GB 2411674 A 9/2005
WO 2005/106189 A1 11/2005

OTHER PUBLICATIONS

Written Opinion of the International Searching Authority issued in corresponding application No. PCT/EP2016/061984 dated Dec. 22, 2016 (11 pages).
Norwegian Search Report issued in corresponding application No. 20150683 dated Dec. 18, 2015 (2 pages).

* cited by examiner

ANCHOR MODULE, CASING PLUG ASSEMBLY AND METHOD FOR OPERATING A CASING PLUG ASSEMBLY IN A WELL PIPE

BACKGROUND

One or more embodiments of the present invention relate to a casing plug. One or more embodiments of the present invention also relate to a well anchor, which may be used together with the casing plug, but which may also be used with other well tools.

There are different types of well plugs used in hydrocarbon producing wells. Such plugs may be retrievable plugs, i.e. they may be retrieved from the well after their use, or they may be permanent plugs, i.e. they are set permanently and must be milled/drilled into pieces in order to be removed.

The well plug may comprise an anchor device, which in the set state (radially expanded state) is in contact with the inner surface of the well pipe. Its primary object is to prevent upwardly and/or downwardly directed movement of the plug in relation to the well pipe.

The well plug may also comprise a sealing device, which in the set state (radially expanded state) also is in contact with the inner surface of the well pipe. Its primary object is to prevent fluid to pass the annular space between the outer surface of the plug and the inner surface of the well pipe.

Plugs are set by means of a running tool lowered into the well. The running tool is connected to the plug, and at the desired depth, the running tool is actuated and the plug is brought from its run state (radially retracted state) to its set state (radially expanded state).

One common connection interface between a plug and a running tool comprises an inner mandrel of the plug connected to an inner mandrel of the running tool and an outer housing of the plug connected to an outer housing of the running tool. By relative axial movement between the outer housing and the inner mandrel, the plug is brought from its run state to its set state. In order to initiate this relative movement, an axial force larger than a certain threshold is applied to the inner mandrel while holding the outer housing stationary (or vice versa). At this force threshold, a shear stud is sheared off, and consequently relative axial movement is allowed. The shear stud may be located in the plug or in the running tool.

Casing plugs are one type of well plug used during completion of a hydrocarbon well, during temporary plugging and abandonment (P&A) of the well etc. The casing plug is set in the casing pipe by using drill pipe to run the plug, to set the plug and also to retrieve the plug. One or more embodiments of the present invention may provide a casing plug with the following capabilities:

- it should be possible to hang off weight under the plug such as drill pipe, bottom hole assembly, sensors, etc.
- it should be possible to pump fluid through the plug before an equalizing valve is closed, in order to check the pressure under the plug, for example to check that the completion operation was successful.
- the plug should be resettable, e.g. it should be possible to run the plug to a desired position, then set the plug and perform a pressure test, then to run the plug to a new desired position, set the plug again and then perform a pressure test again.
- it should be possible to abandon the plug in a set and closed state, i.e. to retrieve the running tool and drill pipe after the setting and closing of the plug.

Such a resettable casing plug is difficult to achieve with shear studs, hence, shear studs for the resetting configuration should be avoided.

Typically, such setting and resetting of the plug have been actuated by rotation of the drill pipe. A disadvantage is that it is difficult to ascertain how much the lower part of the drill string has rotated in relation to how much the upper part of the drill string has rotated, particularly for long drill strings. Another disadvantage is that there is a risk that one of the joints of drill pipe will be unscrewed, instead of bringing the plug to the desired state.

Consequently, one or more embodiments of the present invention may achieve a casing plug which has the above capabilities while avoiding the disadvantages of the rotating drill pipe.

Another known way of initiating the setting operation of the plug has been to use so-called drag blocks to create friction between the plug and the inner surface of the casing. Such drag-blocks are typically connected to the plug via coil springs, allowing the drag-blocks to move in relation to the plug due to irregularities of the inner surface of the casing etc. The friction is however sufficient to form an initial anchor which keeps some parts of the plug stationary while moving other parts by means of the pipe string. One example is shown in U.S. Pat. No. 3,714,983.

One known way of achieving fluid actuated plugs is to provide the plug with a closed compartment at the surface. When the plug is lowered into the well, the pressure of the fluid in the annulus outside the plug is typically much higher than the pressure within the closed compartment. Hence, by opening a passage between the annulus and the compartment, fluid will flow from the annulus and into the compartment—a fluid flow which may be used to bring at least parts of the plug from the run state to the set state. An initial operation is here always needed to open the passage at the desired location in the well. One example is shown in U.S. Pat. No. 3,294,171. Here, the opening of the passage is initiated by detent means which are moved upwards into engagement with a joint or other obstruction provided in the inner surface of the casing itself. Moreover, this approach may also requires shear pins.

Hence, in the above two approaches, a first, initial contact between the plug and the casing is needed in order to achieve a second contact in the form of a proper anchoring of the plug to the casing. Moreover, the two approaches above are irreversible (opening of the passage to the atmospheric compartment and the breaking of shear pins).

One or more embodiments of the invention may provide an improved initial anchoring of the casing plug to the casing—without the use of drag blocks and/or gas filled compartment of the above prior art.

SUMMARY

One or more embodiments of the present invention relate to an anchor module for anchoring to a well pipe, comprising: an inner mandrel having a through bore; an outer housing provided radially outside at least a section of the inner mandrel; a slips device provided radially outside the inner mandrel and axially between a first slips support and a second slips support; a spring device provided radially outside of the inner mandrel and radially inside of the outer housing; a fluid actuation system; and an upper connector provided in the upper part of the anchor module, wherein relative axial movement of the first and second slips supports towards each other are bringing the slips device to a set state, wherein relative axial movement of the first and second slips supports away from each other are bringing the slips device to a run state, wherein the spring device is biased to bring the slips device to its run state, and wherein the fluid actuation system provides a relative axial movement of the first and second slips supports towards each other by increasing the fluid flow through the bore to a predetermined threshold value, thereby creating a fluid pressure counteracting the pressure applied by the spring device.

One or more embodiments of the present invention relate to a method for operating a casing plug assembly in a well pipe, the casing plug assembly comprising a running tool, an equalizing module, a seal module and an anchor module, wherein the method comprises the steps of:

a) running the casing plug assembly to a desired location in the well pipe by means of a drill string;
b) pumping a fluid through the drill string and further through a fluid channel through the casing plug assembly;
c) setting the anchor module by increasing the fluid flow through the fluid channel;
d) setting the seal module in the well by applying an axial pressure to the drill string against the set anchor module; and
e) testing the well integrity below the seal module by increasing the pressure of the fluid in the drill string and casing plug assembly.

One or more embodiments of the present invention relate to a casing plug assembly for performing an operation in a well pipe, comprising: a running tool for connection to a drill pipe; an equalizing module; a seal module; an anchor module, wherein a continuous fluid channel is formed through the casing plug assembly, wherein the anchor module is set in the well pipe by pumping fluid through continuous fluid channel, and wherein the anchor module in the set state is providing a support in the well pipe used by the running tool to operate the seal module.

BRIEF DESCRIPTION OF THE DRAWINGS

Embodiments of the invention will be described in detail with reference to the enclosed drawings, where.

DETAILED DESCRIPTION

Figures 1, 2, 3:
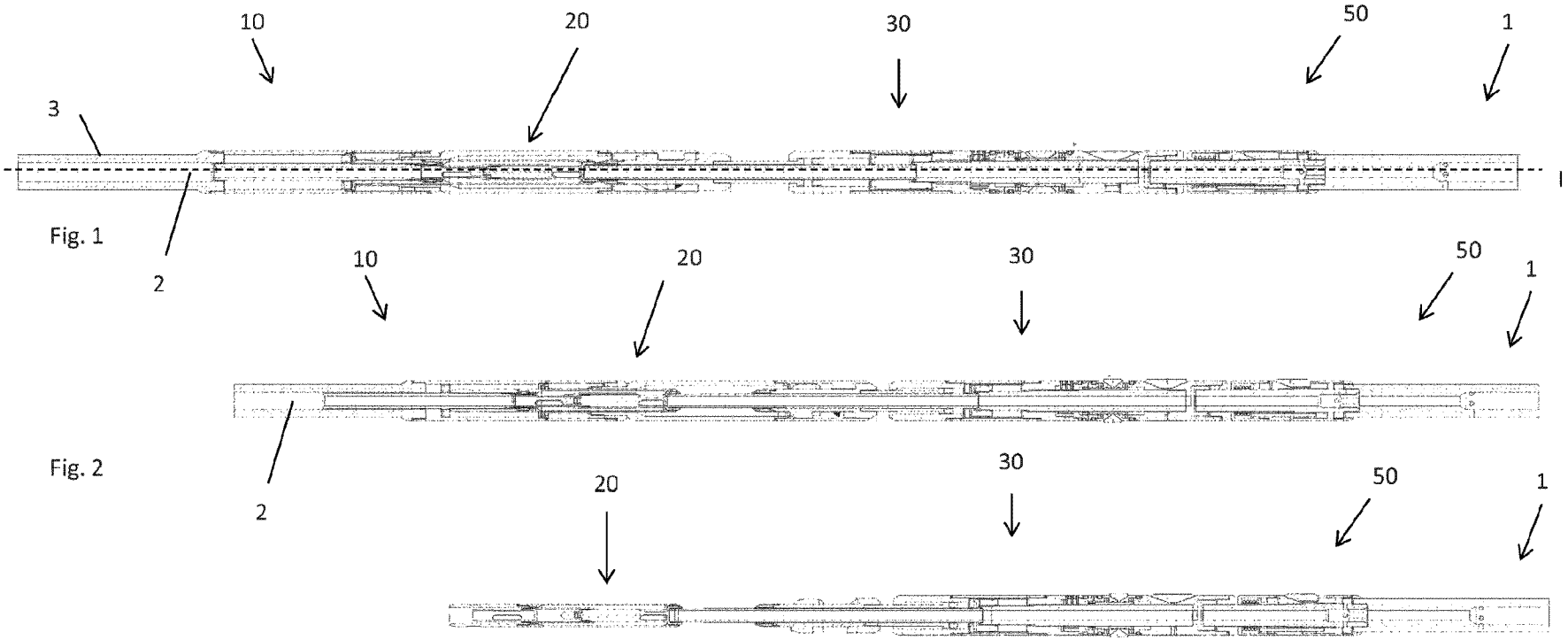
FIG. 1 illustrates the casing plug assembly with a plug and a running tool in the run state.
FIG. 2 illustrates the casing plug assembly in the set state.
FIG. 3 illustrates the casing plug abandoned in the well.

It is now referred to FIGS. 1 and 2. Here it is shown a casing plug assembly 1, comprising a running tool 10, an equalizing module 20, a seal module 30 and an anchor module 50. Hence, the modules 20, 30 and 50 together form a casing plug.

In the drawings, the upper side, i.e. the side of the assembly being closest to the top of the well, is to the left. The lower side, i.e. the side of the assembly being closest to the bottom of the well, is to the right. The axial direction is indicated by a dashed line I in FIG. 1.

In FIG. 1, the run state is shown, in FIG. 2 the set state is shown. In FIG. 3, the running tool 10 has been disconnected from the plug (i.e. the modules 20, 30, 50) and retrieved out of the well, and hence, the plug has been abandoned in the well. This state is referred to as an abandoned state.

A continuous fluid channel 2 is formed through the casing plug assembly 1, as shown in FIGS. 1 and 2.

In FIG. 1, it is shown that the upper part of the running tool 10 comprises a drill string connector section 3. Hence, the casing plug assembly 1 is run on drill string connector section 3 into the well. In addition, the lower part of the casing plug assembly 1 comprises a connection interface (not shown) for connection to a drill string connector section below the assembly 1.

Figure 4:
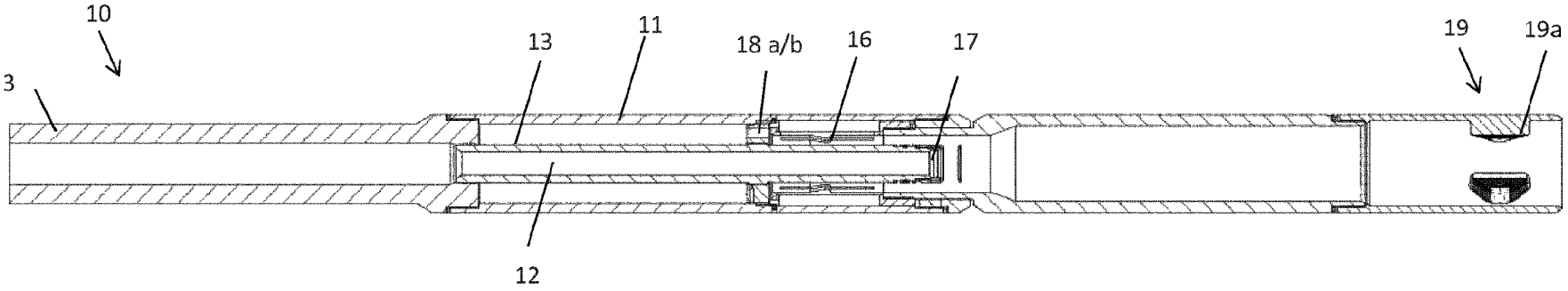
FIG. 4 illustrates the running tool in the run and abandoned state.
Figure 5:
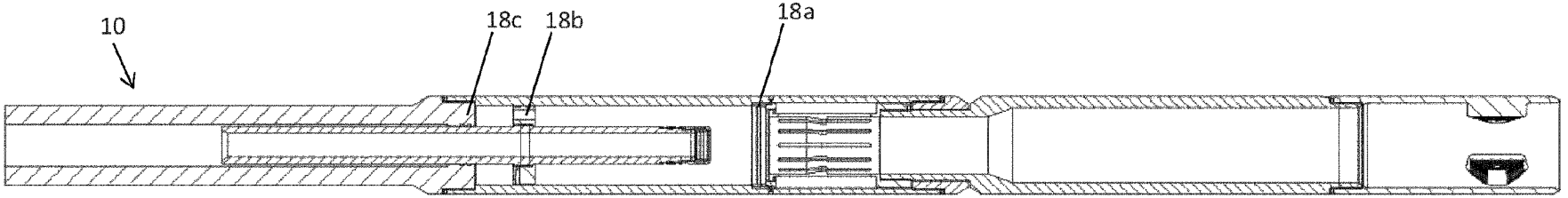
FIG. 5 illustrates the running tool in the set state.

The running tool 10 will now be described with reference to FIGS. 4 and 5. The running tool 10 comprises an outer running tool housing 11 with an inner running tool sleeve 13. The upper part of the outer housing 11 and the upper part of the inner sleeve 13 are connected to the drill pipe connector section 3, which again can be connected to a section of drill pipe. Consequently, reference number 3 may also be considered to represent a section of a drill pipe. A through bore 12 forming a part of the fluid channel 2 is indicated in FIGS. 4 and 5.

The running tool 10 further comprises three lower connection interfaces in the form of a first connector 16 provided radially between the inner sleeve 13 and the outer housing 11, a second connector 17 provided in the lower part of the inner sleeve 13 and a third connector 19 provided in the lower part of the outer housing 11. The third connector 19 comprises inwardly protruding pins 19*a*.

The inner sleeve 13 is axially displaceable in relation to the outer housing 11. The running tool 10 comprises a releasable connector indicated as 18*a/b* in FIG. 4. The purpose of the releasable connector 18*a/b* is to open and close an equalizing sleeve, which will be described below. In the set state in FIG. 5 it is shown that the connector has been released, as there is a distance between the connector element 18*b* following the inner sleeve 13 and the connector element 18*a* fixed to the outer housing 11.

An upwardly directed force applied to the sleeve 13 is required to be above a certain threshold in order to release the connection elements 18*a* and *b* away from each other.

A stop 18*c* will prevent further upwardly directed movement of the inner sleeve 13.

The equalizing module 20 will now be described with reference to FIGS. 6 and 7. The main purpose of the equalizing module 20 is to provide a valve function, which is open and allows fluid flow through the module 20 in the run and set state, and which is closed and prevents fluid flow through the module 20 in the abandoned state.

The equalizing module 20 comprises an equalizing housing 21 with a through bore 22 forming a part of the fluid channel 2, and an equalizing sleeve 23 provided within the equalizing housing 21. The equalizing sleeve 23 is axially displaceable within the equalizing housing 21 between the run and set state in FIG. 6 (fluid flow allowed) and the abandoned state (fluid flow prevented) in FIG. 7.

A first upper connector 26 is provided in the upper part of the equalizing housing 21 and is provided for connection to the first connector 16 of the running tool 10.

A second upper connector 27 is provided in the upper part of the equalizing sleeve 23 and is provided for connection to the second connector 17 of the running tool 10.

The first connectors 16, 26 are a collet finger type of connector.

The second connectors 17, 27 are a ratchet type of connector.

A lower connector 28 is provided in the lower end of the equalizing module 20, which will be described further below.

The equalizing sleeve 23 is connected at its upper end and at its lower end to the equalizing housing 21. An upper fluid seal 23*c* is provided between the upper end of the equalizing sleeve 23 and the equalizing housing 21 and a lower fluid seal 23*d* is provided between the lower end of the equalizing sleeve 23 and the equalizing housing 21 in the open state. Fluid may flow from the bore 12 of the running tool 10 into an upper center opening 24*a* of the sleeve 23, then via radial openings 24*b* in the sleeve 23 out to the annulus 24*c* between the sleeve 23 and the housing 21, then into the sleeve 23*b* via openings 24*d* again and further to the seal module 30 via a lower center opening 24*e* in the sleeve 21. The annulus 24*c* is provided between the upper fluid seal 23*c* and the lower fluid seal 23*d*.

Figure 7:
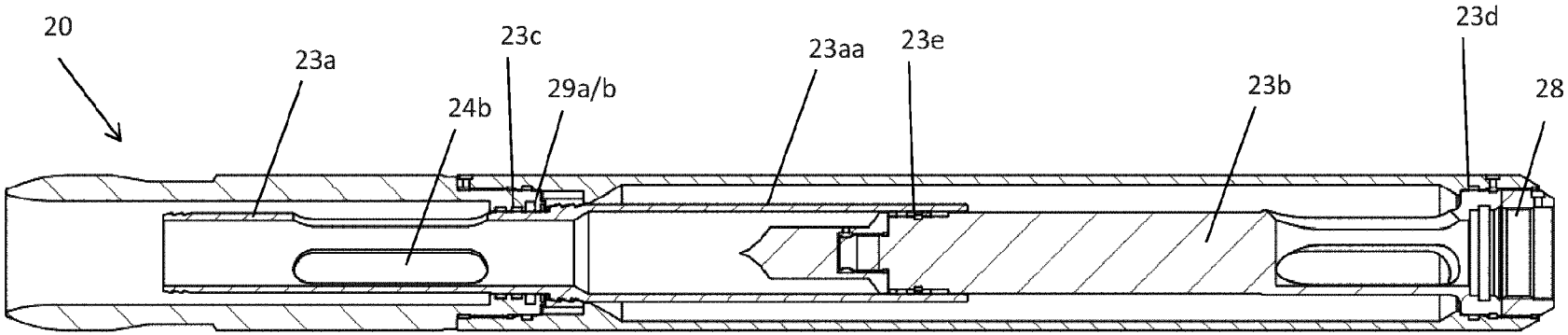
FIG. 7 illustrates the equalizing module in the abandoned state.

In the closed state in FIG. 7, it is shown that the sleeve 23 is formed by two sleeve sections, an upper sleeve section 23*a* and a lower sleeve section 23*b*, where a lower part 23*aa* of the upper sleeve section 23*a* is provided radially outside of the lower sleeve section 23*b*. A third fluid seal 23*e* is provided radially between the upper and lower sleeve sections 23*a*, 23*b* In FIG. 7, these sections have been pulled away from each other, causing a closure of the fluid path 24*a*, 24*b*, 24*c*, 24*d*, 24*e* through the equalizing module 20. Hence, the upper sleeve section 23*a* works as an axially operated valve.

In FIG. 7, the upper sleeve section 23*a* is pulled upwards, causing the opening 24*b* to be moved from the lower side of the upper fluid seal 23*c* to the upper side of the upper fluid seal 23*c*, thereby causing the fluid path through the opening 24*b* into the annulus 24*c* to be closed by the lower part 23*aa* of the upper sleeve section 23*a*.

Figure 6:
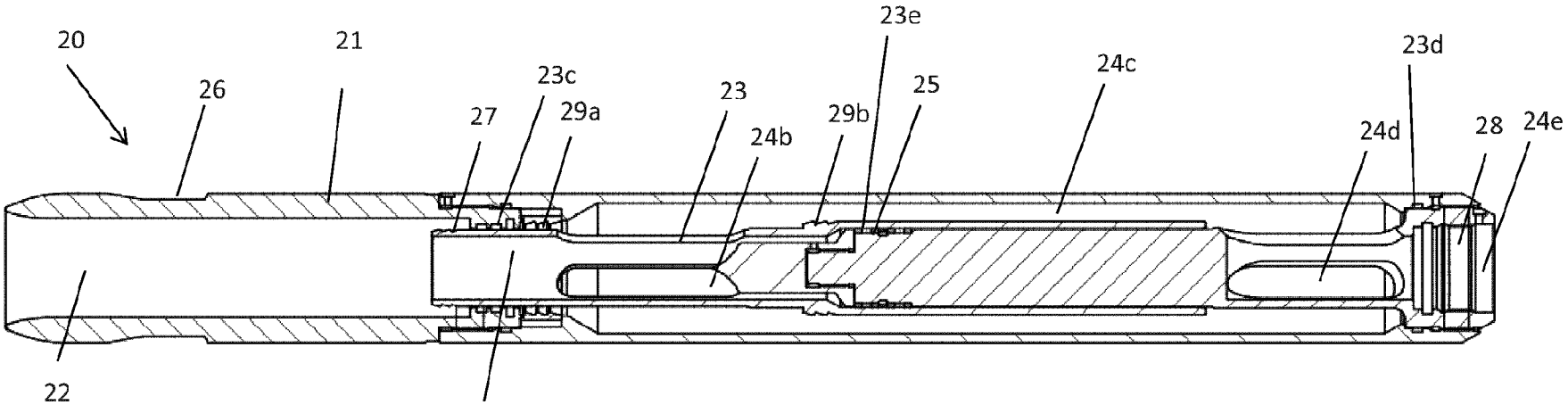
FIG. 6 illustrates the equalizing module in the run and set state.

Reference numbers 29*a* and 29*b* denotes first and second friction elements being disconnected from each other in FIG. 6. In FIG. 7, the connection of the friction elements 29*a/b* is established. Here, a downwardly force above a certain threshold is required in order to bring the friction elements 29 *a/b* away from each other again.

Figure 8:
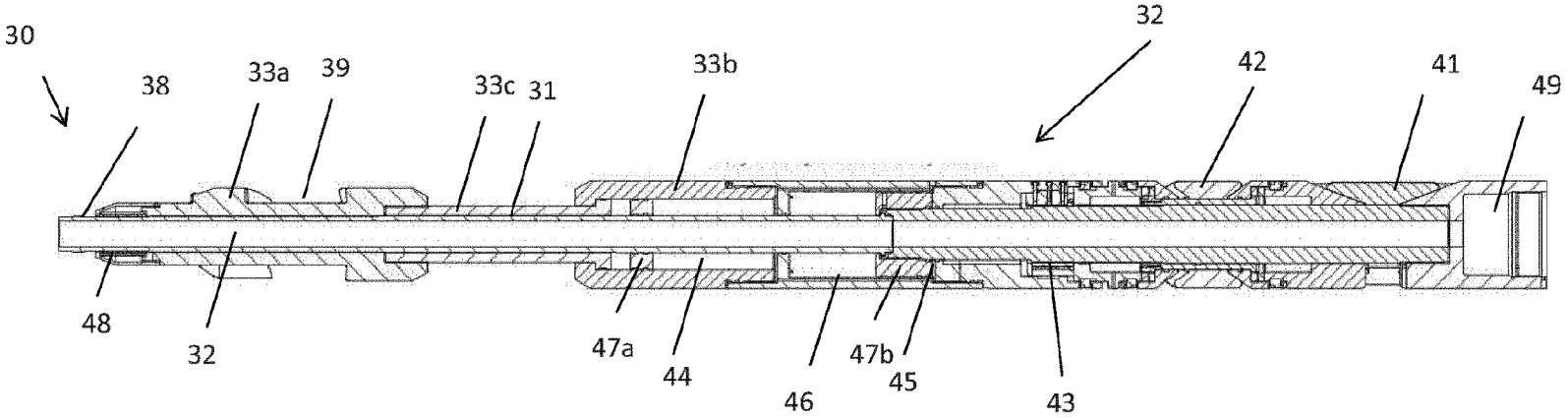
FIG. 8 illustrates the seal module in the run state.

The seal module 30 will now be described with reference to FIGS. 8 and 9. The purpose of the seal module 30 is to seal the annulus between the plug (modules 20, 30, 50) and the inner surface of the well pipe. The seal module 30 comprises a mandrel 31 with a through bore 32 forming a part of the fluid channel 2. The seal module 30 further comprises an outer housing 33, formed by upper and lower housing sections 33*a*, 33*b*, in addition to a center housing section 33*c*.

The upper part of the mandrel 31 comprises a first upper connector 38 for connection to the lower connector 28 of the equalizing module 20. The connectors 28, 38 form a threaded connection.

Figure 12:
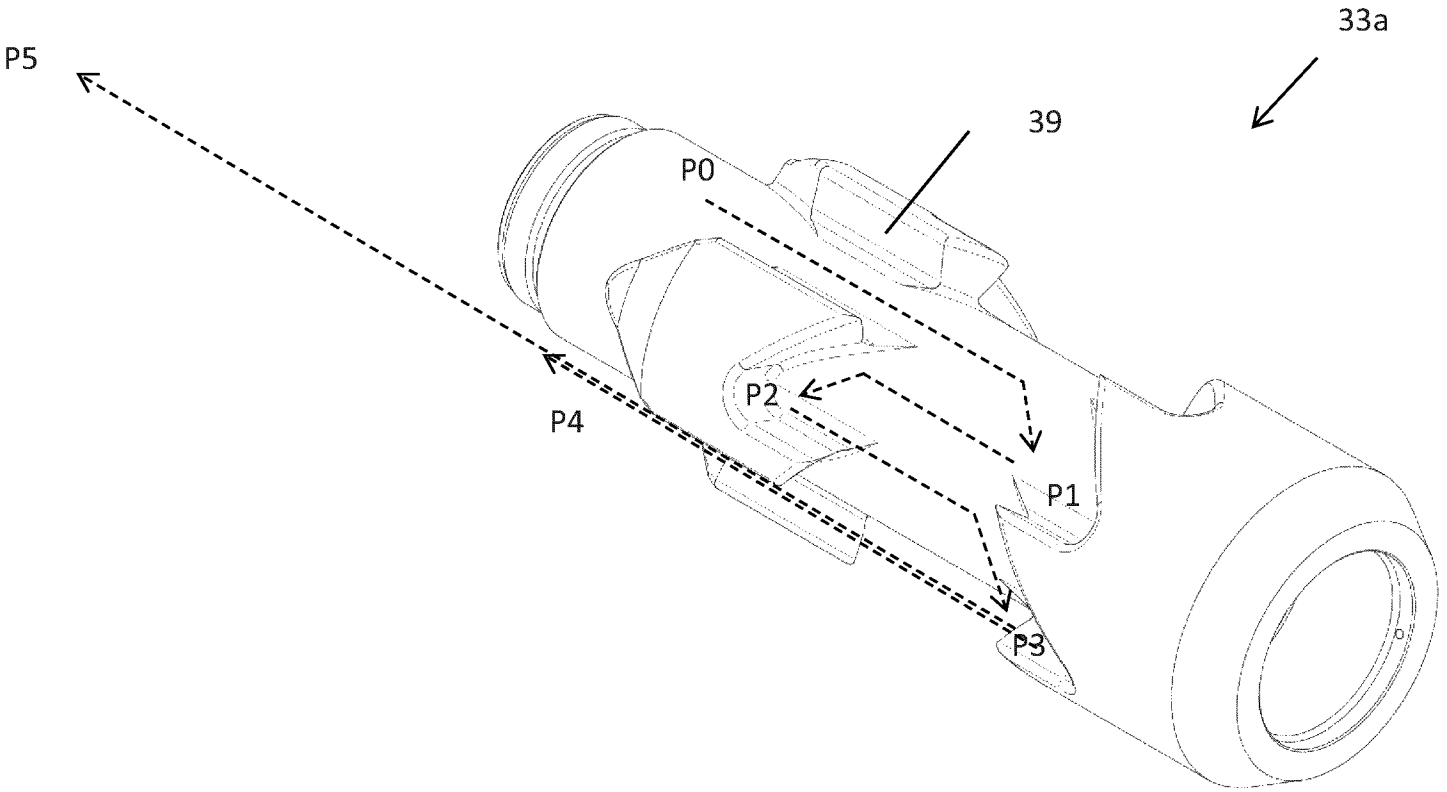
FIG. 12 illustrates a perspective view of the third upper connector of the seal module.

The upper housing section 33*a* comprises a second upper connector 39 for connection to the third connector 19 of the running tool 10. The connectors 19, 39 are J-slot type of connectors. The connector 39 is shown in detail in FIG. 12, having J-shaped slots for engaging with the corresponding pins 19*a* of the connector 19 of the running tool 10. In FIG. 12, it is indicated that the J-slot type of connector has five positions or states P0, P1, P2, P3, P4 and P5. These will be described more in detail below.

The seal module 30 further comprises a plug slips device 41 and a sealing device 42. The purpose of the plug slips device 41 is to engage with the casing pipe in the set state, while the purpose of the sealing device 42 is to prevent axial fluid flow in the annulus between the casing plug assembly and the casing pipe in the set state. The plug slips device 41 and the sealing device 42 are considered to include all elements necessary for their function, including devices needed to support and bring them between their run and set state. They are considered known for the skilled person and hence they will not be described further in detail herein. As is known, by moving the outer housing section 33*b* downwardly in relation to the mandrel 31, the sealing device 42 and the plug slips device 41 will expand radially from the run state to the set state, and by moving the outer housing section 33*b* upwardly in relation to the mandrel 31, the sealing device 42 and the plug slips device 41 will retract radially from the set state to the run state again.

The seal module 30 further comprises a lower connector 49 provided in the lower part of the mandrel 31 for connection to the anchor module 50.

The seal module 30 also comprises a releasable ratchet device 43. A ratchet device 43 generally allows relative movement between two parts in a first direction, while preventing relative movement between the two parts in a second direction opposite of the first direction. Some ratchet devices have an additional released state, in which relative movement between the two parts are allowed in both directions. The releasable ratchet device 43 is here allowing downwardly movement of the lower housing section 33*b* in relation to the mandrel 31, i.e. bringing the seal module 30 from the run state to the set state is allowed, but opposite movement is prevented. However, the ratchet device 43 can be released in order to bring the seal module 30 from the set state to the run state. This is achieved by pulling the drill pipe upwards with a force above a threshold value. The threshold value is in the present embodiment given by the friction provided by a teethed friction mechanism 48 provided between the mandrel 31 and the upper housing section 33*a*, i.e. radially outside of the mandrel 31 and radially inside the upper housing section 33*a*.

Figure 13:
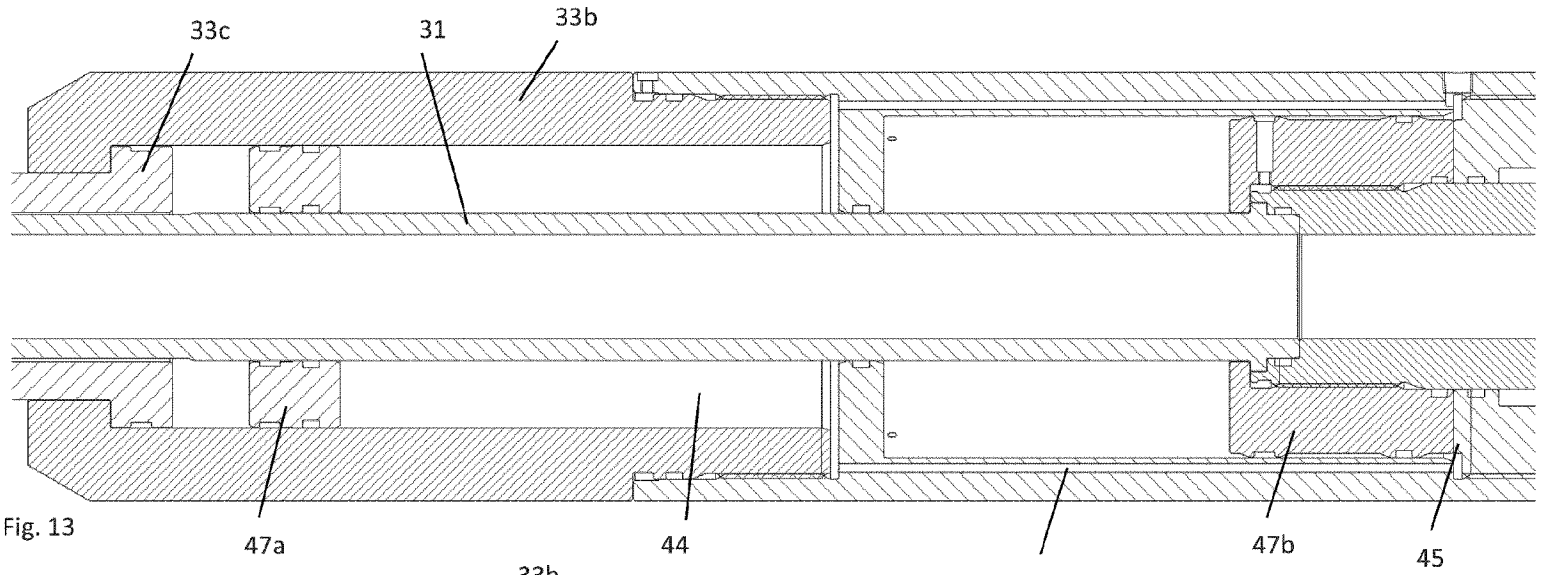
FIG. 13 is an enlarged view of a section of the of the seal module in the run state.
Figure 14:
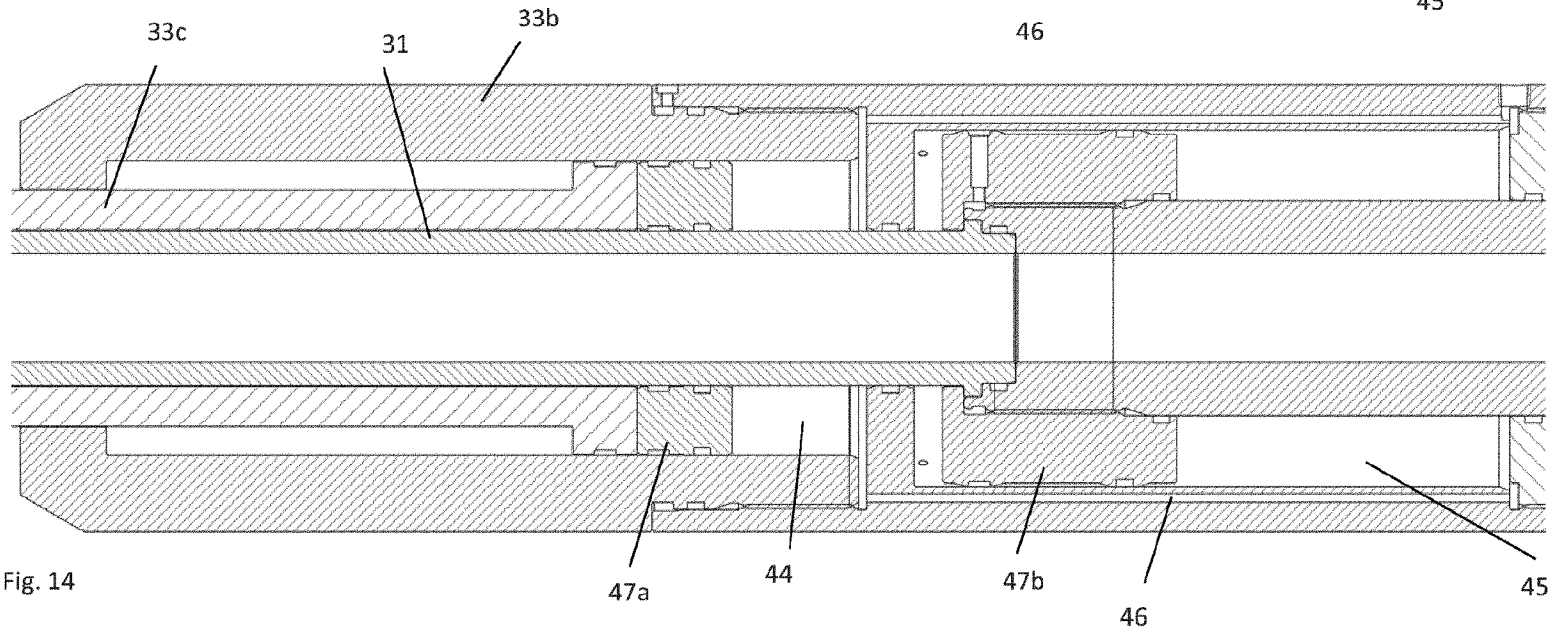
FIG. 14 is an enlarged view of a section of the of the seal module in the set state.

The seal module 30 further comprises a hydraulic setting system comprising a first fluid chamber 44, a second fluid chamber 45, a fluid channel 46 between the first and second fluid chambers 44, 45, a first piston 47*a* in the first fluid chamber 44 and a second piston 47*b* in the second fluid chamber 45. As shown in FIGS. 13 and 14, the center housing section 33*c* may be axially displaced into the second housing section 33*b*, thereby pushing the first piston 47*a* down into the first fluid chamber 44, displacing fluid through the channel 46 to the lower side of the second piston 47*b*, thereby pushing the second piston 47*b* upwards into the second fluid chamber 45 under hydraulic pressure from the fluid in chamber 45. The second piston 47*b* is fixed to the mandrel 31, and hence, the mandrel 31 will also be moved upwardly in relation to the second housing section 33*b*, causing a setting of the plug slips device and sealing device 41, 42.

Figure 10:
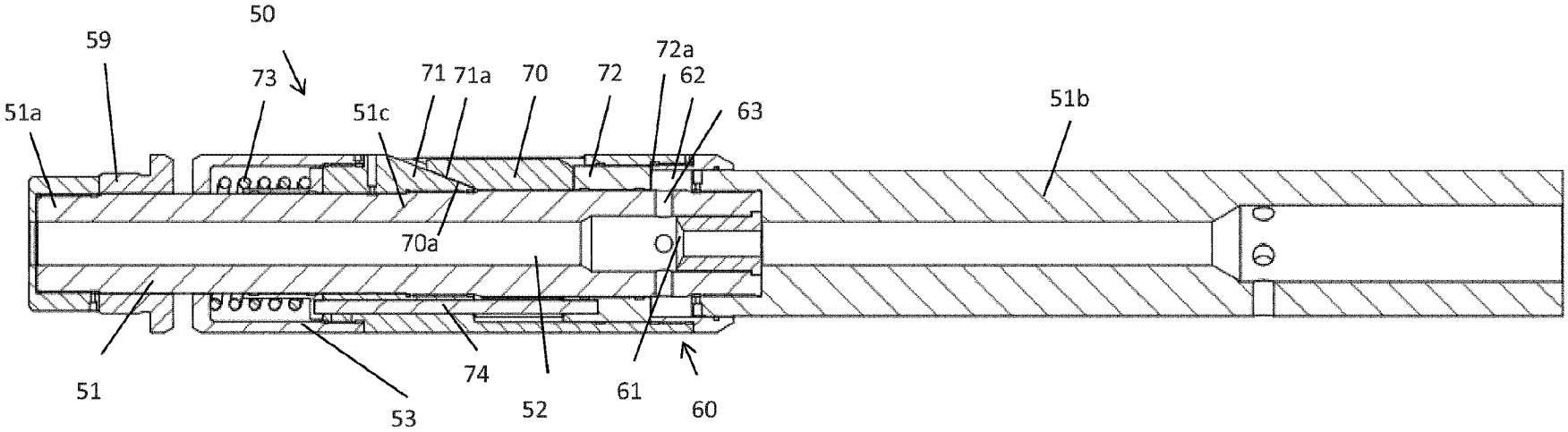
FIG. 10 illustrates the anchor module in the run state.
Figure 11:
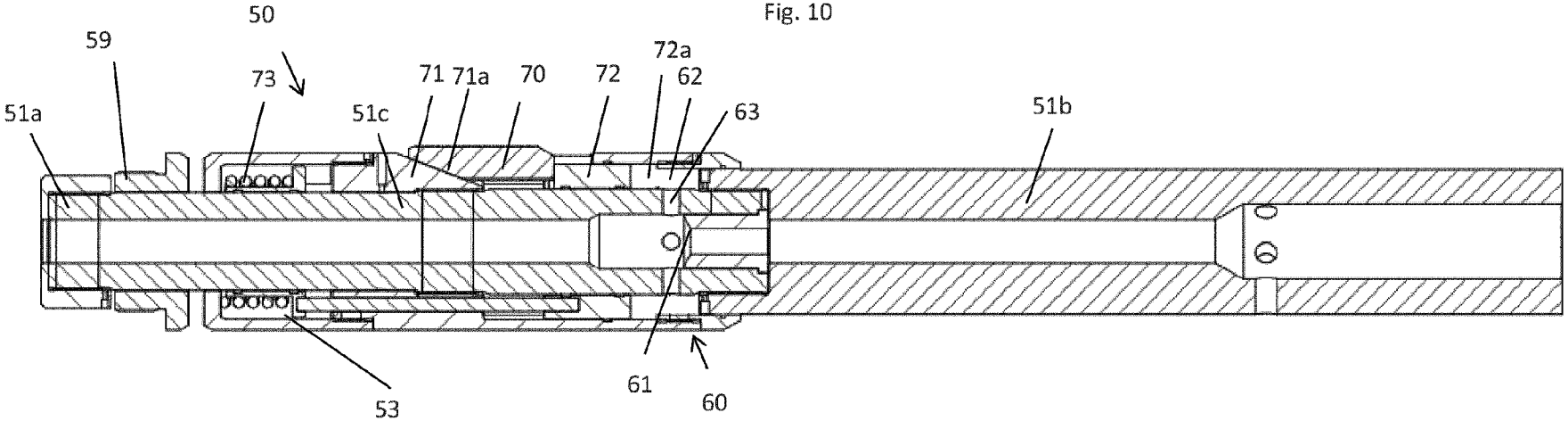
FIG. 11 illustrates anchor module in the set state.

The anchor module 50 will now be described with reference to FIGS. 10 and 11. The anchor module 50 comprises an inner anchor mandrel 51 having a through bore 52 forming a part of the fluid channel 2. The anchor module 50 further comprises an outer housing 53 provided radially outside at least a section 51*c* of the inner mandrel 51. In FIG. 10, it is shown that the mandrel 51 has an upper section 51*a*, a lower section 51*b* and a center section 51*c*.

An upper connector 59 is provided in the upper part of the module 50, here outside of the upper section 51*a* of the mandrel 51. The upper connector 59 is connected to the lower connector 49 of the seal module 30. The connectors 49, 59 comprise a threaded connection allowing rotational motion between the seal module 30 and the anchor module 50.

An anchor slips device 70 is provided radially outside the inner mandrel 51 and axially between a first slips support 71 and a second slips support 72. The slips device 70 comprises gripping teeth (not shown) for preventing downward movement of the anchor module 50 in relation to the well pipe in the set state. Hence, upwardly directed movement of the anchor module 50 is in the present embodiment not prevented by the anchor slips device 70.

Here, the first slips support 71 comprises an inclined surface 71*a* engaged with a corresponding inclined surface 70*a* of the slips device 70. Hence, a relative axial movement of the first and second slips supports 71, 72 towards each other is bringing the slips device 70 to a set state, while a relative axial movement of the first and second slips supports 71, 72 away from each other is bringing the slips device 70 to a run state.

A spring device 73 is provided radially outside of the inner mandrel 51 and radially inside the outer housing 53. In the present embodiment, the second slips support 72 is connected mechanically to the spring device 73 by one or several axial rods 74. The spring device 73 is biased to bring the slips device 70 to its run state, i.e. to press the second slips support 72 downwardly. In the present embodiment, the second slips support 72 is axially movable and where the first slips support 71 is fixed to the inner mandrel 51 and to the outer housing 53.

The anchor module 50 is actuated by means of a fluid actuation system 60. The fluid actuation system 60 is configured to provide a relative axial movement of the first and second slips supports 71, 72 towards each other when the fluid flow through the bore 52 is providing a fluid pressure counteracting the force from the spring device 73. The fluid actuation system 60 comprises a fluid restriction 61 in the bore 52, a piston chamber 62 provided radially outside of the inner mandrel 51 and radially inside of the outer housing 53, and a fluid channel 63 between the piston chamber 62 and the bore 52 above the fluid restriction 61. The second slips support 72 is forming a piston in the piston chamber 62. Hence, when fluid pressure in the piston chamber 62 increases to a level higher than the pressure applied from the second slips support 72 via rod 74, the second slips support 72 moves upwards and brings the slips device 70 to the set state.

Due to the weight below and also above the slips device 70, the slips device 70 will achieve a substantial engagement with the inner surface of the casing. Hence, the anchor module 50 will continue to be in the set state even if the fluid flow decreases and stops. However, if the anchor module 50 is pulled upwards via the connector 59, the slips device 70 will loose its engagement with the casing and the anchor module will go back to its run state.

Description of Operation of Casing Plug Assembly

In the following, the operation of the casing plug assembly will be described.

Initially, the casing plug assembly 1 is assembled and connected to a drill string via the drill string connector section 3. Due to the weight of the modules (20, 30, 50) and possibly also other drill strings or equipment hanging below the casing plug assembly 1, the pins 19*a* will be in position P2 in FIG. 12.

The casing plug assembly 1 is now run to a desired location in the well by means of the drill string. At the desired location, fluid may be pumped through the drill string and further through the equalizing module 20, the seal module 30, the anchor module 50 and further down in the well.

The anchor module 50 is set by increasing the fluid flow through the fluid channel 2 thus increasing the pressure in the fluid chamber 62 of the anchor module 50. The anchor module 50 now forms a support, which the seal module, equalizing module and running tool can be pressed towards.

In a next step, the seal module 30 is set in the well by applying an axial force to the drill string. The pins 19*a* will now move to position P3 in FIG. 12, the upper housing section 33*a* will be pressed downwardly forcing the center housing section 33*c* into the housing section 33*b* of the seal module 30. It should be noted that here, the intention is that the housing section 33*a* should move downwards in relation to the casing pipe due to the weight of the drill string—the intention is not that the mandrel 31 is moved a larger distance upwards in relation to the casing string. Such a larger upwardly directed movement of the mandrel 31 could cause a release of the anchor module 50.

Figure 9:
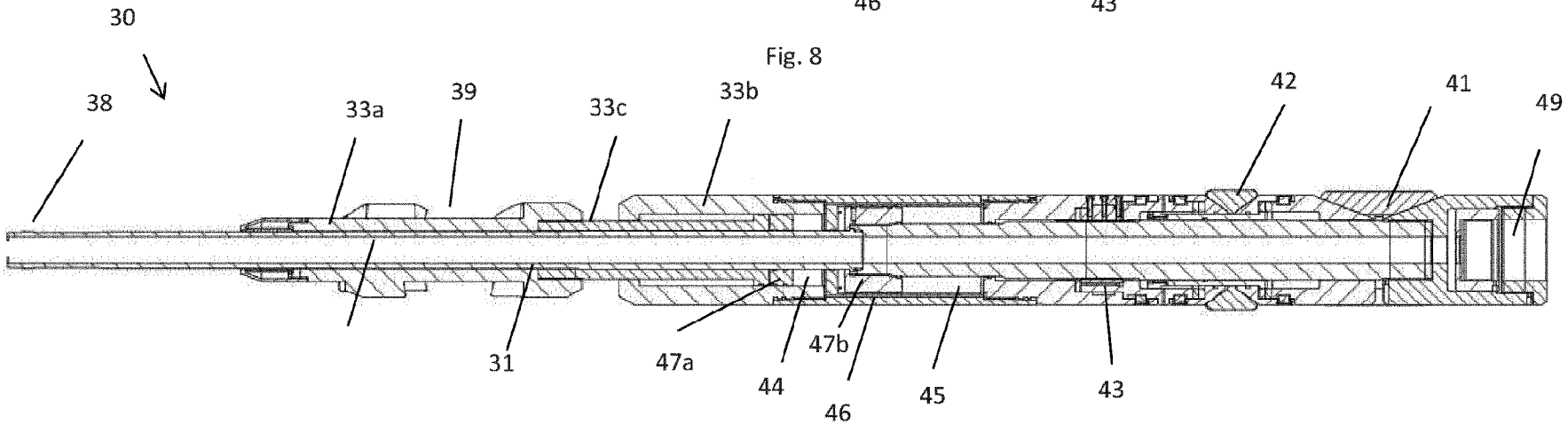
FIG. 9 illustrates seal module in the set state.

As described above, this will cause the second piston 47*b* to move to the position shown in FIGS. 9 and 14, and the releasable ratchet device 43 will prevent movement in the opposite direction.

In FIG. 5, it is shown that the sleeve 18 of the running tool 10 has moved upwards in relation to the outer housing 11.

The well integrity below the seal module 30 may now be tested by increasing the pressure of the fluid in the drill string and casing plug assembly 1. Such a well integrity test will of course also verify the casing plug seal itself.

There are now two options, either to abandon the plug (i.e. the modules 20, 30 and 40) and retrieve the drill pipe and running tool 10 or to move the well plug assembly 1 to a new position.

If the first option is selected, then a predetermined first push and/or pull sequence on the drill string is performed. Here, the first predetermined push and/or pull sequence is performed by pulling the drill string once. Hence, the pins 19*a* will move from position P3 to position P5 in FIG. 12. During this upwardly directed movement, the ratchet device 43 will prevent upwardly directed movement of the lower housing section 33*b*, and hence, the seal module 30 and the anchor module 50 will be kept in the set state.

However, the sleeve section 23*a* of the equalizing module 20 remains connected to the running tool via connection 17/27 and will be pulled upwards with the running tool. When the equalizing sleeve reaches its rearmost position, the connection 29*a*/*b* (FIG. 7) will be made, and the connection 18*a*/*b* will be made (FIG. 4). The running tool 10 is thus returned to its run state as shown in FIG. 4. The equalizing module 20 is at this point in its abandon state, as shown in FIG. 7. Lastly, the connection 17/27 will be undone, separating the running tool 10 from the abandoned casing plug 20, 30, 50. Hence, the casing plug will hold differential pressure, preventing fluid to pass the plug from above or below.

From this state, or if the second option is selected, the running tool is moved downwards to reconnect with the seal module. As the running tool reconnects with the set and abandoned seal module, the connector 17 interfaces with the connector 27. The coupling 18*a/b* ensures that the connection is made. As the running tool is continually moved downwards, the connection 29*a/b* is released, allowing the equalizing sleeve section 23*a* to travel downwards. When the equalizing sleeve 23 is fully open, the sleeve 13 contacts the housing 21, and the connection 18*a/b* is released. The pins 19*a* are at this point in position P0. Continued motion downwards of the running tool moves the pins 19*a* into position P1. From this state, upwards motion of the running tool moves the pins 19*a* into position P2. By pulling the running tool 10 upwards with a force above a certain threshold, the friction coupling between the upper housing section 33*a* and mandrel 31 will be overcome, and the upper housing section 33*a* with the connector 39 will be pulled upwards. When the center housing section 33*c* returns to its upper position inside lower housing section 33*b*, the pulling force is transferred to the outer housing 33. With continued pull upwards, the plug is released by opening the lock ring device 43, allowing the outer housing 33 to travel upwards and the sealing device and anchor device to return to their run states. Once the plug has been released, the pulling force can be transferred to the lower anchor, enabling it to return to its run state. The casing plug assembly is fully reset in this state, and can be set again following the procedure described above. Alternatively, the assembly may be pulled from the well.

Here, in the second option, the second predetermined push and/or pull sequence comprises to pull the running tool 10 to position P4/P0, push the running tool 10 down again to position P1, pull the running tool 10 to position P2 and then pull further upwards to the new desired location.

It should be noted that the above anchor module 50 is providing a proper anchoring to the casing. Hence, there is no need for a first initial contact and then a second, proper anchoring. Hence, some of the disadvantages with prior art is avoided.

Alternative Embodiments

It should be noted that the above anchor module can be used with other plug types than casing plugs. Alternatively, the anchor module can be used as a separate anchor, for example by modifying it to have an upper connector similar to the third connector 39 described above.

It should be noted that the above J-slot/pin connector 39/19*a* may have a different design, such as a different number of slots, which again may cause that a different push/pull sequence is needed.

The invention claimed is:

1. A method for operating a casing plug assembly in a well pipe, the casing plug assembly comprising a running tool, an equalizing module, a seal module and an anchor module, wherein the method comprises the steps of:

a) running the casing plug assembly to a desired location in the well pipe by means of a drill string;

b) pumping a fluid through the drill string and further through a fluid channel through the casing plug assembly;

c) setting the anchor module by increasing the fluid flow through the fluid channel;

d) setting the seal module in the well by applying an axial pressure to the drill string against the set anchor module; and e) testing the well integrity below the seal module by increasing the pressure of the fluid in the drill string and casing plug assembly.

2. The method according to claim 1, wherein the method comprises the steps of:

abandoning the equalizing module, the seal module and the anchor module in the well by:

closing the fluid channel by closing a fluid path through the equalizing module; and disconnecting by pulling the drill string and a running tool away from the equalizing, seal, and anchor modules.

3. The method according to claim 2, wherein the method comprises the steps of:

lowering the drill string and the running tool to the equalizing module, the seal module and the anchor module;

reconnecting the running tool to the equalizing module, the seal module and the anchor module;

opening the fluid channel by opening the fluid path through the equalizing module; and reconfiguring the running tool.

4. The method according to claim 1, wherein the method comprises the steps of:

releasing the seal module and the anchor module from the well while reconfiguring the equalizing module, the seal module and the anchor module.

5. A casing plug assembly for performing an operation in a well pipe, comprising:

a running tool for connection to a drill pipe;

an equalizing module;

a seal module;

an anchor module comprising a slips device, wherein a continuous fluid channel is formed through the casing plug assembly, wherein the slips device of the anchor module is set in the well pipe by pumping fluid through the continuous fluid channel, and wherein the slips device of the anchor module in the set state provides a support in the well pipe used by the running tool to operate the seal module.

6. The casing plug assembly according to claim 5, wherein the anchor module comprises:

an inner mandrel having a through bore;

an outer housing provided radially outside at least a section of the inner mandrel;

a spring device provided radially outside of the inner mandrel and radially inside of the outer housing;

a fluid actuation system; and an upper connector provided in the upper part of the anchor module, wherein the slips device is provided radially outside the inner mandrel and axially between a first slips support and a second slips support, wherein the casing plug assembly brings the slips device to a set state by relative axial movement of the first and second slips supports toward each other, wherein the casing plug assembly brings the slips device to a run state by relative axial movement of the first and second slip supports away from each other, wherein the spring device is biased to bring the slips device to its run state, and wherein the fluid actuation system provides a relative axial movement of the first and second slips supports towards each other by increasing the fluid flow through the bore to a predetermined threshold value, thereby creating a fluid pressure counteracting the pressure applied by the spring device.

7. The casing plug assembly according to claim 5, wherein the running tool is operating the seal module by axial movement of the drill pipe alone.

8. The casing plug assembly according to claim 5, wherein the equalizing module comprises an axially operated valve for opening and closing the fluid path through the equalizing module.

9. The casing plug assembly according to claim 5, wherein the seal module comprises a J-slot type of connector, and wherein the running tool comprises pins for engagement with the connector.

10. The casing plug assembly according to claim 5, wherein the connector of the seal module is provided on an upper housing section provided radially outside a mandrel, wherein relative axial movement of the upper housing section and the mandrel is bringing the seal module between its run state and its set state.

11. The casing plug assembly according to claim 5, wherein a toothed friction mechanism is provided between a mandrel and an upper housing section.

12. The casing plug assembly according to claim 5, wherein the seal module comprises a sealing device and a slips device.

13. A method for operating a casing plug assembly in a well pipe, the casing plug assembly comprising a running tool, an equalizing module, a seal module and an anchor module, wherein the method comprises the steps of:

a) running the casing plug assembly to a desired location in the well pipe by means of a drill string;

b) pumping a fluid through the drill string and further through a fluid channel through the casing plug assembly;

c) setting a slips device of the anchor module by increasing the fluid flow through the fluid channel;

d) setting the seal module in the well by applying an axial pressure to the drill string against the set slips device of the anchor module; and e) testing the well integrity below the seal module by increasing the pressure of the fluid in the drill string and casing plug assembly.

14. The method according to claim 13, wherein the method comprises the steps of:

abandoning the equalizing module, the seal module and the anchor module in the well by:

closing the fluid channel by closing a fluid path through the equalizing module; and disconnecting by pulling the drill string and a running tool away from the equalizing, seal, and anchor modules.

15. The method according to claim 14, wherein the method comprises the steps of:

lowering the drill string and the running tool to the equalizing module, the seal module and the anchor module;

reconnecting the running tool to the equalizing module, the seal module and the anchor module;

opening the fluid channel by opening the fluid path through the equalizing module; and reconfiguring the running tool.

16. The method according to claim 13, wherein the method comprises the steps of:

releasing the seal module and the anchor module from the well while reconfiguring the equalizing module, the seal module and the anchor module.

* * * * *